US005233926A

United States Patent [19]

Carmichael et al.

[11] Patent Number: 5,233,926

[45] Date of Patent: Aug. 10, 1993

[54] ADHESIVE SECONDARY BLASTING CONE

[75] Inventors: Calvin W. Carmichael, Chelmsford; Paul J. Dolan; Robert Park, both of Sudbury, all of Canada

[73] Assignee: INCO Limited, Toronto, Canada

[21] Appl. No.: 780,622

[22] Filed: Oct. 23, 1991

[30] Foreign Application Priority Data

Jun. 5, 1991 [CA] Canada ..... 2043926

[51] Int. Cl.[5] ..... F42D 3/00

[52] U.S. Cl. ..... 102/302; 102/312; 102/313; 86/20.15

[58] Field of Search ..... 86/20.15; 102/302, 312, 102/313; 299/13

[56] References Cited

U.S. PATENT DOCUMENTS

| | | | |
|---|---|---|---|
| 449,272 | 3/1891 | Puskas | 102/307 |
| 2,247,169 | 6/1941 | Gilbertson | 102/5 |
| 2,595,960 | 5/1952 | Lawrence | 102/24 |
| 3,159,102 | 12/1964 | Riedl et al. | 102/22 |
| 3,431,850 | 3/1969 | Christopher | 102/24 |
| 3,566,790 | 3/1971 | Knight, Jr. | 86/20.15 X |
| 3,619,308 | 11/1971 | Caldwell et al. | 149/60 |
| 3,791,255 | 2/1974 | Fox et al. | 86/20.15 |
| 3,996,836 | 12/1976 | Lichtenberg | 86/20.15 |
| 4,289,354 | 9/1981 | Zakiewicz | 299/13 X |
| 5,071,496 | 12/1991 | Coursen et al. | 102/313 X |
| 5,099,763 | 3/1992 | Coursen et al. | 11/313 |

*Primary Examiner*—Peter A. Nelson
*Attorney, Agent, or Firm*—Edward A. Steen

[57] ABSTRACT

A shaped secondary blasting charge including a frustoconical container and a viscous adhesive explosive overpacked into the container. A concave cover accommodates the overloaded explosive which is removed at the blasting site. The container with the explosive is pressed against the object to be blasted causing the viscous explosive to intimately bond to the surface.

9 Claims, 1 Drawing Sheet

ADHESIVE SECONDARY BLASTING CONE

TECHNICAL FIELD

The instant invention relates to blasting techniques in general and, more particularly, to an explosive charge configuration especially adapted to break up large rocks, pieces of ore, aggregated materials, and the like into smaller pieces for subsequent handling.

BACKGROUND ART

After the completion of a primary blasting program within an underground excavation, there remain large boulders, rocks and pieces of ore. These materials may be found individually scattered on the floor; clumped together; or hung up in boxholes, chutes and ore passes. The size of these blast products must be sufficiently reduced before they can be subsequently handled.

Accordingly, secondary blasting is undertaken to break up the residual oversize boulders. There are generally three methods used in secondary blasting:

1) Blockholing—one or more holes are drilled into a boulder and filled with an explosive. The explosive is detonated thereby fracturing the rock. This method, although economical in the use of explosives, involves considerable expense in preparation and labor. It often causes subsequent damage due to flyrock ruining surrounding air and water lines, ventilation tubing, support screens, etc. Additional dangers may be experienced by drilling into missed holes or caused by moving muck. It is also quite dangerous to drill upwardly into a hanging boulder inasmuch as the roof or sidewalls may be unstable.
2) Sandblasting—placing an explosive charge on a boulder under a blanket of sand (the process may be also carried out without sand). This usually requires a larger quantity of explosives than blockholing with the attendant increased damages to the surrounding area. Reblasting is frequently required because the charge is inefficiently shaped and improperly placed. Time is further wasted since the charge must be made up at the site.
3) Concussion, boxhole, chute or ore pass blasting—these require access to notoriously unstable rock formations located in the chutes, boxholes and ore passes present in underground excavations. It is unsafe to work under hung up chutes and passes so the usual procedure is to hang a primed charge at the end of a pole and insert the charge and pole into the chute or pass. This is inefficient since the hanging charge may have little or no contact with the trapped rock.

The latter two methods transfer high energy to the stope walls causing potential rock falls and loose ground conditions. As with sandblasting, concussion blasting may also damage mine services—water, air and electrical lines, ventilation tubing, etc.

Concussion and sandblasting attempt to break rock by using the explosive as a "giant hammer" to explode against or adjacent to the rock and fracture it.

An example of a secondary blasting charge is disclosed in U.S. Pat. No. 2,247,169. A flexible capsule having a flange is filled with an explosive. A circumferential rabbet holds the explosive in place. An adhesive is placed on the flange and the entire unit is placed against the rock with the flange adhesive holding the unit to the rock.

Unfortunately, due an air gap formed between the explosive and the rock, a decided loss of shock energy may be experienced thereby reducing the effectiveness of the charge in spite of the attached flange.

Essentially, there is a need for a secondary explosive that is relatively fast to set up, less labor intensive and costly than current techniques, less wasteful of explosive energies normally dissipated and possibly directed against mine services, and perhaps most importantly safe to use.

SUMMARY OF THE INVENTION

There is provided a cone shaped explosive secondary charge especially adapted for fragmenting boulders and the like. A viscous explosive charge having adhesive properties overflows the cone and is placed in intimate contact with the rock. This configuration minimizes energy loss by directing the bulk of the explosive forces directly against the rock.

PREFERRED EMBODIMENT OF THE INVENTION

Figure 2:
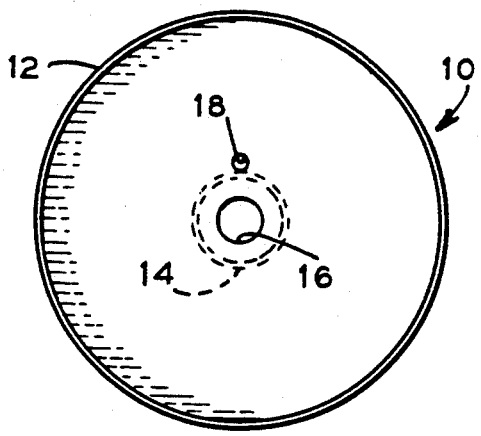
FIG. 2 is a view taken along line 2—2 of FIG. 1.
Figure 1:
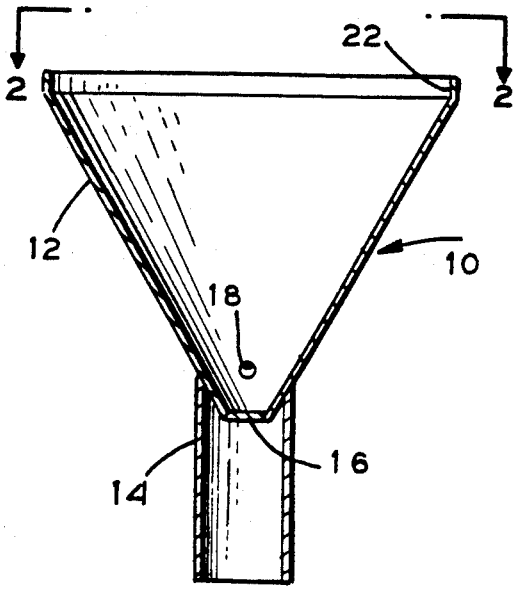
FIG. 1 is a cross sectional view of an embodiment of the invention.

Referring to FIGS. 1 and 2, there is shown a secondary blasting charge 10.

Figure 3:
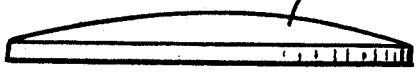
FIG. 3 is a side view of a feature of the invention.

The charge 10 includes a cone 12 and a tube 14 extending from the apex 16 of the cone 12. A hole 18 for a detonating cord may be formed in the cone 12 near the apex 16. As shown in FIG. 3, removable cover 20, having a convex exterior surface to specifically permit overfilling of the explosive into the cone 12, may be placed over the open end 22 of the cone 12 to facilitate transport to the job site.

Figure 4:
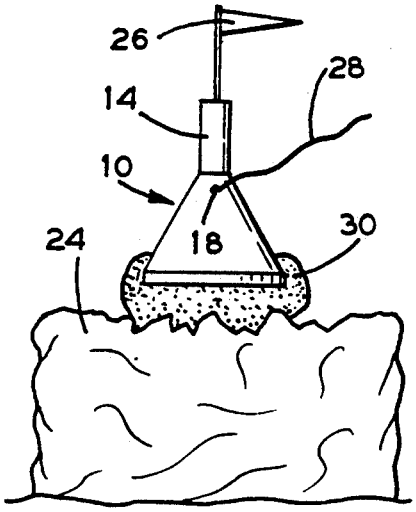
FIG. 4 is an embodiment of the invention disposed on a boulder.

FIG. 4 depicts the charge 10 on a boulder 24. A warning flag 26 may be disposed in the tube 14. A detonating cord 28 extends from the hole 18.

The cone 12 is over packed with any suitable explosive mixture 30 augmented with additives to impart malleability and tackiness to the compound. Explosive emulsions formulated with microballoons, guars or polyacrylamides are useful. It is important to pack enough viscous explosive 30 into the cone so that a portion oozes out, ice cream cone fashion, about the end 22. Indeed, the cover 20 accommodates the overflow of explosive 30 so when the cover 20 is removed, the explosive 30 extends beyond the confines of the cone 12.

Although the surface imperfections of the boulder 24 are shown to be somewhat exaggerated, an object of the invention is for the protruding explosive 30, upon the removal of the cover 20, to be squeezed against and into the interstices of the irregular rock surface. The explosive 30 fills the voids and adheres to the rock thereby achieving maximum coupling. There is no air or intervening membrane of any kind between the explosive 30 and the rock 24.

This intimate gluing or coupling is further assisted by the height of the cone 12 and the location of the detonating point in the apex 16 which should be selected to ensure that the explosive 30 is accelerated to full velocity at the point of impact with the boulder 24.

As a result of extensive testing, it is preferred to utilize a molded plastic cone 12 having a wall thickness of about 1.6 mm (0.063 inches). The cone 12 may be about 14.6 cm (5.75 inches) tall and the tube 14 may be about 8.3 cm (3.25 inches) long. The open end 22 outside diameter may be about 16.8 cm (6.62 inches) and the tube 14 outside diameter may be about 3.8 cm (1.5 inches). Approximately 1.7 kilograms (3.8 pounds) of high velocity cap sensitive explosive is forced into the cone 12.

A preferred explosive emulsion 30 having the requisite viscous, tacky characteristics is a mixture of fuel oil and trapped particles of ammonium nitrate. By adjusting the quality of the above-referenced additives, the density and sensitivity of the explosive may be modulated to effect the characteristics of the charge. A commercially available suitable explosive emulsion is marketed by Imperial Chemical Industries, Toronto, Canada under the trademark Magnafrac 1000.

The conical design of the charge 10 is such that the great bulk of the kinetic energy generated by the explosive is directed against the boulder. Only a minimum of energy escapes in any unwanted direction. This simple efficient design, which does not require internal baffling and does not affirmatively create the Munroe effect, allows the use of one secondary charge 10 instead of several standard charges. Flyrock, air concussion, and the resulting damage to the environment is reduced. By the same token, a series of charges 10 may be fired simultaneously or in timed sequence to fragment particularly troublesome boulders.

The explosive shock energy initiated out of the apex 16 develops at the point of detonation and moves forward at a high rate of speed, generally referred to as the Velocity of Detonation ("VOD"). This shock energy is reflected from any free face and is adversely affected by any change in medium (rock to air: explosives to package to air to rock). Because the instant invention utilizes a coupled charge, the shock energy moves freely from the explosive into the rock and through the rock until interrupted by a free or open face. This shock wave front moves forward in the rock as a very high compressive wave which is then reflected from every free face as an equal and opposite tensile wave. These tensile waves cause the rock to literally be torn apart.

As a result of a successful experiment testing regimen, it has been determined that the cord 28 and a detonating knot disposed adjacent to the hole 18 are a convenience for tie-in by the miner. This configuration also ensures the explosive starts to detonate at the point furthest from the coupled surface. The knot is composed of approximately one foot of cord which is, in general 50 grain cord or the equivalent of four #12 blasting caps. It is preferred to apply four times the minimum primer for detonation to over-drive and jump-start the explosive. As a result of tests run on various high velocity primers and low velocity economical explosives such as ANFO or TNT slurries, it was determined only a very high velocity cap-sensitive emulsion or water-gel gave the necessary full velocity in the short distance allowed, that is about 14 cm (5.5 inches). The lower velocity explosives, even with heavy boostering would only bend a 2.5 cm (1 thick) thick steel plate while the emulsion, thus primed, would drive a full diameter hole right through the plate. These tests deliberately avoided any gas jet (Munroe) effects and were used to establish a velocity of detonation build-up within the cone length only.

Figure 5:
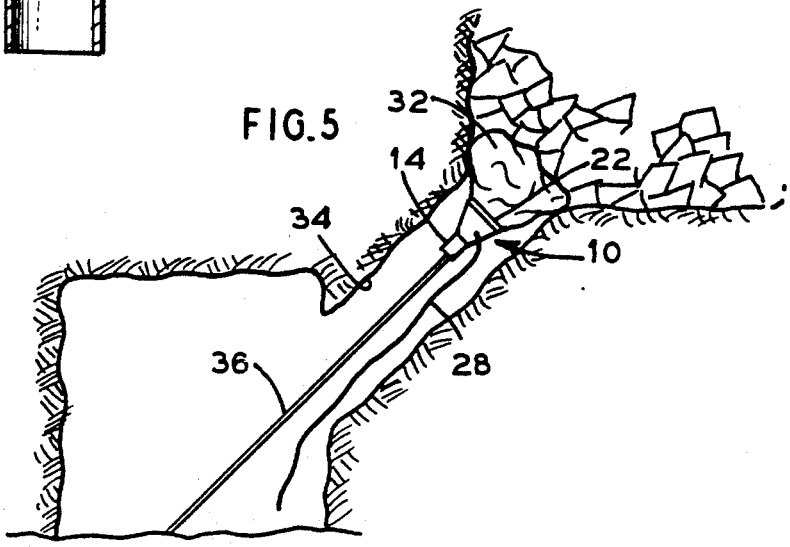
FIG. 5 is an embodiment of the invention disposed in a chute.

FIG. 5 depicts the blasting charge 10 coupled against a stuck rock 32 in an underground ore chute 34. A pole 36 is inserted into the tube 14. The pole is then manipulated so that the open end of the cone 22 is adhesively forced against the rock 32. This design permits miners to access unstable areas from relative safety. Instead of simply hanging freely in the air near a rock from a stick, the explosive 20 is affirmatively affixed to the rock to maximize the blast effect.

Besides causing efficient rock fragmentation, the instant blasting charge 10 reduces the need for blockholing, the requirement of additional drills and the need for directly working under unstable ground. The charge 10 may be assembled off site, easily placed directly against the rock after the removal of the cover 20, and utilized to safe and efficient advantage.

While in accordance with the provisions of the statute, there are illustrated and described herein specific embodiments of the invention. Those skilled in the art will understand that changes may be made in the form of the invention covered by the claims and the certain features of the invention may sometimes be used to advantage without a corresponding use of the other features.

The embodiments of the invention in which an exclusive property or privilege is claimed are defined as follows:

1. A blasting charge comprising a frustoconical housing having an open end, the housing adapted to be affixed to an object to be blasted, a viscous adhesive explosive disposed within the housing and partially extending out of the open end so as to contact the object to be blasted, and means for detonating the explosive.

2. The blasting charge according to claim 1 including a removable housing cover adopted to contain the explosive within the housing prior to contact with the object.

3. The blasting charge according to claim 1 wherein the housing includes means for accepting a pole.

4. The blasting charge according to claim 1 wherein the housing includes a hole adapted to receive a detonating cord.

5. The blasting charge according to claim 1 wherein an excessive quantity of the explosive is disposed within the container.

6. The blasting charge according to claim 1 wherein a detonating agent selected from the group consisting of detonating cords, cast primers and blasting caps is disposed at the apex of the frustoconical container.

7. The blasting charge according to claim 2 wherein the housing cover is adapted to accommodate an excessive quantity of explosive disposed within the container.

8. The blasting charge according to claim 1 including high velocity explosive.

9. The blasting charge according to claim 4 wherein the detonating cord includes a knot.

* * * * *